United States Patent [19]

Kunieda et al.

[11] Patent Number: 4,740,659

[45] Date of Patent: Apr. 26, 1988

[54] POLLUTION-PROOF INSULATOR

[75] Inventors: Shigehiko Kunieda, Iwakura; Toshimi Suzuki, Aichi, both of Japan

[73] Assignee: NGK Insulators, Ltd., Japan

[21] Appl. No.: 19,139

[22] Filed: Feb. 25, 1987

[30] Foreign Application Priority Data

Aug. 29, 1986 [JP] Japan ..... 61-204948

[51] Int. Cl.[4] ..... H01B 17/56; H01B 17/50

[52] U.S. Cl. ..... 174/211; 174/212

[58] Field of Search ..... 174/150, 177, 178, 179, 174/186, 209, 211, 212

[56] References Cited

U.S. PATENT DOCUMENTS 4,174,464 11/1979 Kawaguchi et al. ..... 174/211 X

FOREIGN PATENT DOCUMENTS 973561 3/1960 Fed. Rep. of Germany ..... 174/212
1286554 1/1962 France ..... 174/212
1543444 9/1968 France ..... 174/212

*Primary Examiner*—Laramie E. Askin
*Attorney, Agent, or Firm*—Parkhurst & Oliff

[57] ABSTRACT

The disclosed insulator has one or more sheds integrally formed with the central core so that each shed extends radially outward from the core. Each shed has an annular rib extending downward from the lower surface thereof, and the lower edge of the rib extends outwardly with respect to the central core.

6 Claims, 3 Drawing Sheets

POLLUTION-PROOF INSULATOR

BACKGROUND OF THE INVENTION

1. Field of the Invention

This invention relates to a pollution-proof insulator, and more particularly the invention relates to the shape of sheds of a pollution-proof insulator of various types, such as long-rod-type, station post-type, or bushing shell.

2. Related Art Statement

The insulating strength of insulators is maximized when their surfaces are clean. If the insulator surface is polluted with deposit of electrolytic pollutants, such as salt from sea water and industrial wastes, and if such electrolytic pollutants are moistened with rain, mist or dew so as to become an electrolytic solution, the insulating strength of the insulator surface is reduced by the presence of such electrolytic solution thereon.

To deal with such reduction in insulating strength due to the deposit of electrolytic pollutants, pollution-proof insulators having an increased leakage distance have been proposed. The increased leakage distance acts to maintain a sufficiently high insulating strength of the insulator even if the insulator surface is polluted. FIG. 6 shows an example of conventional pollution-proof insulators. The illustrated pollution-proof insulator 5 has a central core portion 1 from which two kinds of sheds, namely a large shed 3A and a small shed 4, extend radially in a staggered fashion. The shed projection a of the large shed 3A, namely the distance a from the outer surface of the core portion 1 to the outer edge 2 of the large shed 3A, is longer than that for the small shed 4. Thus, the large shed 3A and the small shed 4 are disposed in a staggered fashion.

The pollution-proof insulator 5 of FIG. 6 has been used extensively throughout the world due to the following advantages thereof; namely, (i) excellent rain washing characteristics, (ii) high resistance against deposition of pollutants when the insulator is used in a desert region, (iii) prevention of inter-shed flashover under rain conditions due to an increased spacing between adjacent large sheds, (iv) ease in manufacture, and so on.

On the other hand, the actual performance of the pollution-proof insulator 5 has indicated the following difficulties.

(1) The diameter of the core portion 1 between adjacent sheds (inter-shed core portion) is constant regardless of the positions of sheds, and the current density at the inter-shed core portion is high, so that the inter-shed core portion tends to become dry zones.

(2) Accordingly, simultaneous local arcs can be originated comparatively easily at a number of root portions 6*a* of adjacent sheds.

(3) Once local arcs occur at shed root portions 6*a*, they can move comparatively easily to outer edges 2 of the large and small sheds 3A and 4, because the spacing between adjacent sheds is small and substantially parallel arc paths are formed.

(4) The local arcs which have occurred at shed root portions 6*a* and moved to shed outer edges 2 of the sheds 3A and 4 tend to develop into inter-shed arcs which may eventually lead to an overall flashover.

(5) With the conventional insulators, when specific leakage distance as defined below is larger than a certain value, the effectiveness of the leakage distance on the withstand voltage under polluted conditions (to be referred to as "the pollution withstand voltage", hereinafter) is reduced. Here, the specific leakage distance is the ratio of the leakage distance L per paired sheds to the pitch of shed P (L/P) (see FIG. 6).

SUMMARY OF THE INVENTION

Therefore, an object of the present invention is to overcome the above-mentioned difficulties of the prior art by providing an improved pollution-proof insulator.

To achieve this object, in the pollution-proof insulator according to the invention, the space between adjacent sheds is divided into three portions, i.e., two portions in contact with the inter-shed core surface (spaces A and B of FIG. 1) and a portion separated from the core surface (space C of FIG. 1). In that portion which is separated from the core surface, current density is kept low and dry zones are hard to occur. Accordingly, the leakage distance can be increased without reducing the effectiveness of the leakage distance on the pollution withstand voltage, and the anti-pollution characteristics is remarkably improved.

A pollution-proof insulator of the invention does not use the conventional small shed 4 of FIG. 6. Instead, an annular rib is formed on the lower surface of each shed in such a manner that the rib has a lower edge thereof directed outwardly with respect to the central core portion of the insulator.

In an embodiment of the pollution-proof insulator according to the invention, an additional rib is formed on the lower surface of each shed at a position between the central core portion of the insulator and the above-mentioned rib with lower edge thereof directed outwardly. The additional rib provides an elongated leakage distance for the shed.

A number of sheds may extend radially from the central core portion with spacing in the longitudinal direction of the core portion. Each of the sheds has a rib which extends downwardly from the lower surface of the shed in such a manner that the lower edge of the rib is directed outwardly with respect to the core portion.

Features of the pollution-proof insulator of the invention can be summarized as follows.

(a) The elimination of the conventional small shed 4 and the formation of the annular rib on the lower surface of the shed result in a much longer shed-root spacing b (FIG. 1) than that of the staggered sheds type insulator of FIG. 6 without any reduction of the specific leakage distance. The shed-root spacing b represents the linear distance between adjacent sheds along the core surface. Since the density of leakage current is maximized on the core surface, the invention provides a long path in a region where the leakage current density is maximized. The rib at the lower surface of the shed defines a shed-root space A between the rib and the core surface. Due to the long shed-root spacing b and the presence of the shed-root space A, local arcs occurring on the core surface hardly move to the outer edge of the shed and such local arcs cannot last long on the core surface.

(b) A fairly large under-rib space B is formed between the lower portion of the rib formed on one shed and the upper surface of a next lower shed, as compared with the inter-shed space of a conventional pollution-proof insulator. The under-rib space B acts to prevent the local arcs, which occur on the core surface having a high leakage current density, from moving toward the outer edge of the rib.

(c) An outer-edge space C is formed between the lower portion of the rib and the outer portion of the shed from which the rib extends. The insulator surface along this outer-edge space C has a low leakage current density and dry zone is hard to occur thereon. Thus, local arcs are hardly originated in the outer-edge space C. Even when the local arcs occur on the core surface and move up to the under-rib space B, the outer-edge space C suppresses further movement of such local arcs, so as to prevent occurrence of overall flashover. The outwardly directed lower edge of the rib acts to resist against deposit of pollutants on the insulator. Besides, the rib of the invention has little interference against rain and wind coming from side direction, so that good rain-washing effects are ensured. Thus, the insulator of the invention maintains the advantages of the conventional pollution-proof insulators.

BRIEF DESCRIPTION OF THE DRAWINGS

For a better understanding of the invention, reference is made to the accompanying drawings, in which.

Throughout different views of the drawings, 1 is a core portion, 2 is an outer edge, 3 is a shed, 3A is a large shed, 4 is a small shed, 5 is a pollution-proof insulator, 6a and 6b are root portions of the shed, 7 is a next lower shed, 8 is lower surface, 9 is upper surface, 10 is a rib, 11 is a rib root, 12 is inner surface, 13 is a rib outer edge, 14 is an additional rib, A is a shed-root space, B is an under-rib space, C is an outer-edge space, P is a pitch of shed, Z is a central line, a is a shed edge projection, b is a shed-root spacing, c is a minimum distance, l is a creeping distance, and p is width of a recess opening.

DESCRIPTION OF THE PREFERRED EMBODIMENT

Figure 1:
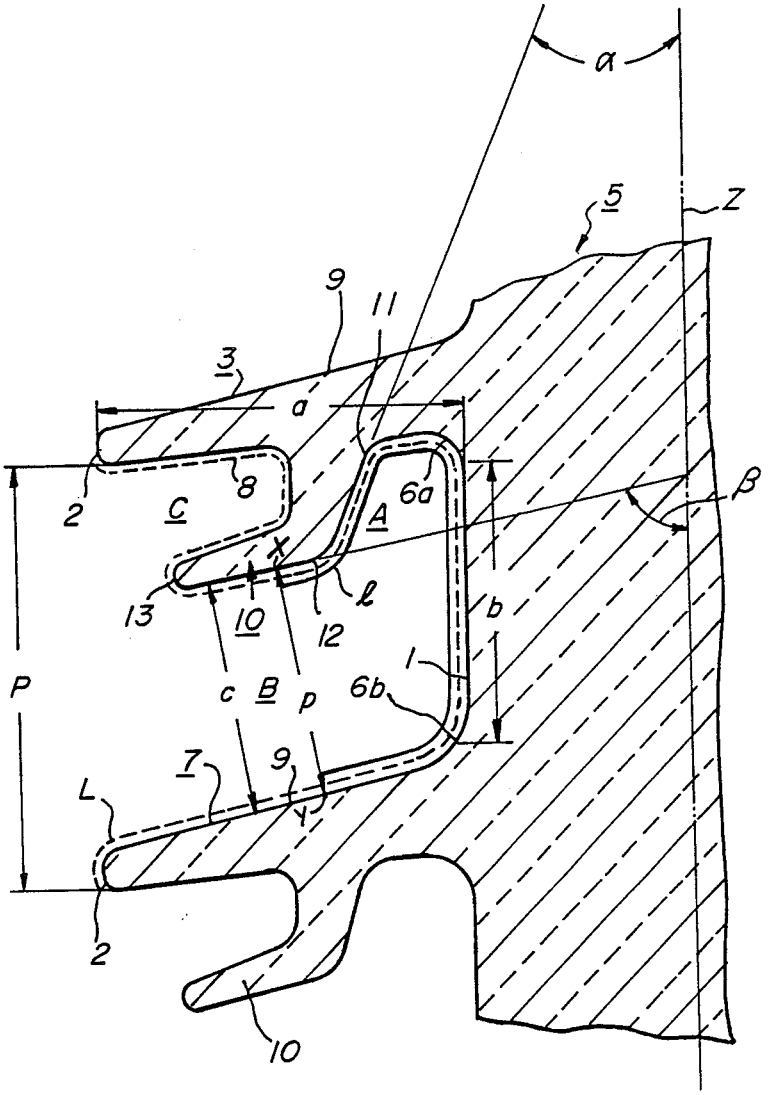
FIG. 1 is a schematic sectional view of the essential portion of a pollution-proof line post insulator according to the invention.
Figure 2:
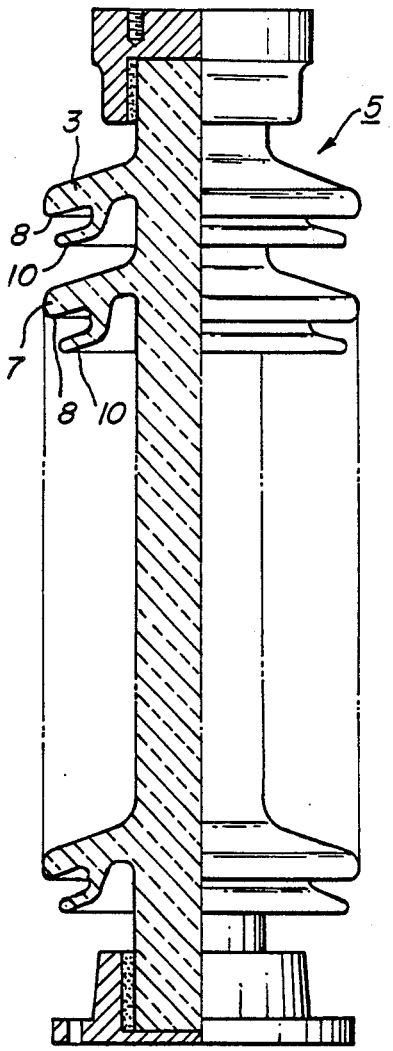
FIG. 2 is an overall side view, with a part thereof in section, of the pollution-proof line post insulator of FIG. 1.

FIG. 1 shows a partial sectional view of a pollution-proof line post insulator according to the invention, and FIG. 2 shows an overall side view of the line post insulator of FIG. 1. The left side half of FIG. 2 shows the insulator in section.

The pollution-proof insulator 5 of FIGS. 1 and 2 has a shed edge projection a of 95 mm in terms of the difference between the radius of the core portion 1 and the radius of the outer edge 2 of the shed 3. The insulator 5 has a shed pitch P of 100 mm in terms of the distance from one shed 3 to a next lower shed 7.

The shed-root spacing b of the pollution-proof insulator 5, in terms of the distance between the lower surface 8 of one shed 3 and the upper surface 9 of the next lower shed 7 at the shed root portions 6a and 6b thereof, is about 80 mm, which is considerably longer than that of a conventional pollution-proof insulator.

An annular rib 10 is formed at about the middle portion of the lower surface 8 of each shed, such as the illustrated one shed 3 and the next lower shed 7. The rib 10 has an about 30 mm long base portion connected to the lower surface 8 of the shed 3 at a rib root 11 and an outwardly bent portion extending from the tip of the base portion. The inner surface 12 of the rib 10 at the rib base portion passing the rib root 11 defines an inclination $\alpha$ of about 5°–40°, preferably about 20° with the central line Z of the insulator 5, while the inner surface 12 at the outwardly bent portion defines an inclination $\beta$ of about 60°–85°, preferably about 75° with the central line Z.

The outer edge 13 of the rib 10 radially recedes about 15 mm relative to the outer edge 2 of the shed 3. The minimum distance c between the rib 10 of the shed 3 and the upper surface 9 of the next lower shed 7 is about 50 mm.

FIGS. 1 and 2 also show that the next lower shed 7 has a similar rib 10.

The ratio between the leakage distance l of a recess formed at the back of the above-mentioned base portion of the rib 10 and width p of the open end of the recess between the illustrated points X, Y is kept less than 4 ($l/p<4$).

The function and merit of the above embodiment of the invention will be described now. In the embodiment, the conventional small shed 4 with a small shed edge projection a is replaced with the rib 10 formed on the lower surface 8 of the shed 3, so that the embodiment has an increased shed-root spacing b as compared with that of the prior art.

The rib 10 defines two spaces below the shed 3; namely a shed-root space A between the shed root portion 6a along the lower surface 8 of the shed 3 and the above-mentioned base portion of the rib 10, and an under-rib space B between the level of the outwardly bent portion of the rib 10 and the upper surface 9 of the next lower shed 7. Since the minimum distance c between the rib 10 of the one shed 3 and the next lower shed 7 is large in the embodiment of the invention, the volume of the under-rib space B is also large. Due to the presence of the shed-root space A and the large under-rib space B, local arcs occurring on the surface of the core portion 1 hardly move to the outer edges of the shed 3 and the rib 10, and such local arcs cannot last over a long period of time.

Further, with the outer edge 13 of the rib 10 which is so bent as to extend outwardly, a third space or an outer edge space C is defined between the shed 3 and the rib 10. The inner surface of the outer edge space C is completely separated from the peripheral surface of the core portion 1. The density of leakage current on the inner surface of the outer edge space C is so small that dry zones are hardly formed thereby. Accordingly, even if local arcs generated on the core portion 1 between the sheds 3 and 7 should move up to the under-rib space B, the outer edge space C of the shed 3 prevents such local arcs from reaching to similar local arcs on the next lower shed 7 so as to prevent flashover from the shed 3 to the next lower shed 7 or further to a still lower shed (not shown in FIG. 1). Thus, the risk of overall flashover is minimized in the pollution-proof insulator 5 of the illustrated embodiment.

The embodiment of FIGS. 1 and 2 has an advantage in that its specific leakage distance, namely the ratio of the leakage distance L from the shed 3 to the next lower shed 7 as shown in FIG. 1 to the shed pitch P (L/P), can be increased without reducing the effectiveness of the leakage distance for the pollution withstand voltage. Thus, the pollution withstand voltage of the insulator can be considerably improved by using the structure of the invention.

Figure 3:
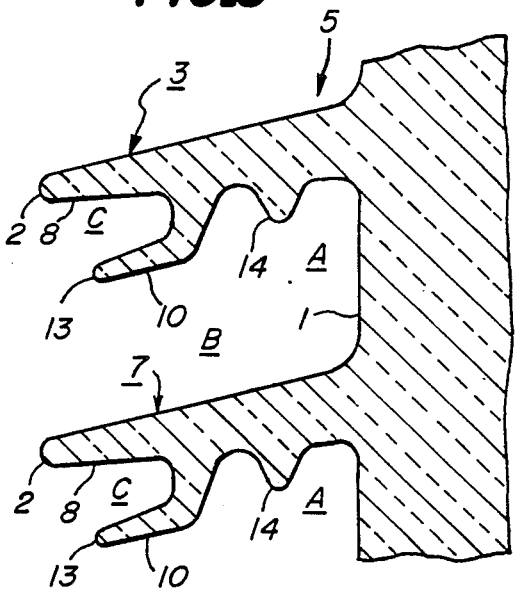
FIG. 3 is a schematic sectional view of the essential portion of an embodiment of the invention which uses an additional rib.

FIG. 3 shows a schematic sectional view of a second embodiment of the invention. In this embodiment, a rib 10 is formed on the lower surface 8 of the shed 3 at a position closer to the shed outer edge 2 as compared with that for the first embodiment of FIG. 1. An additional rib 14 is formed on the lower surface 8 of the shed 3 between the first-mentioned rib 10 and the core portion 1, so that the additional rib 14 projects into the shed-root space A.

In addition to the function and merit of the first embodiment as described above by referring to FIGS. 1 and 2, the second embodiment has an advantage of a long leakage distance including an increment produced by the additional rib 14.

Figure 4:
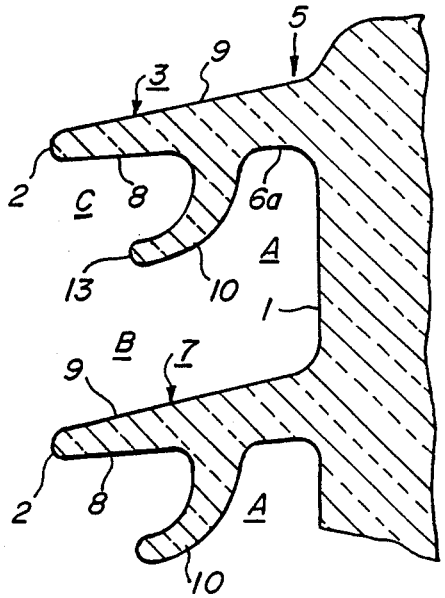
FIG. 4 is a schematic sectional view of an embodiment of the invention with a gradually curved rib.

FIG. 4 shows a schematic partial sectional view of a third embodiment of the invention. The rib 10 of this embodiment is continuously curved from the lower surface 8 of the shed 3 to the rib tip 13 in such a manner that the rib tip 13 is outwardly oriented relative to the core portion 1 of the pollution-proof insulator 5. The curved rib 10 of this embodiment is also effective in suppressing local arcs and preventing the local arcs from moving. Thus, the rib 10 of this embodiment improves the anti-pollution characteristics of the insulator 5.

Figure 5:
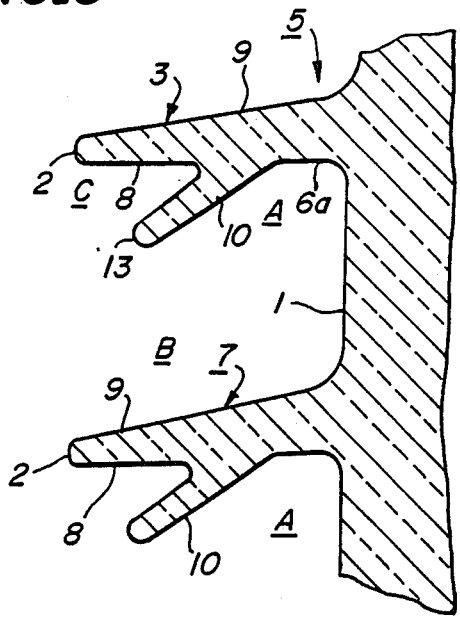
FIG. 5 is a schematic sectional view of another embodiment of the invention which uses an obliquely extending rib.
Figure 6:
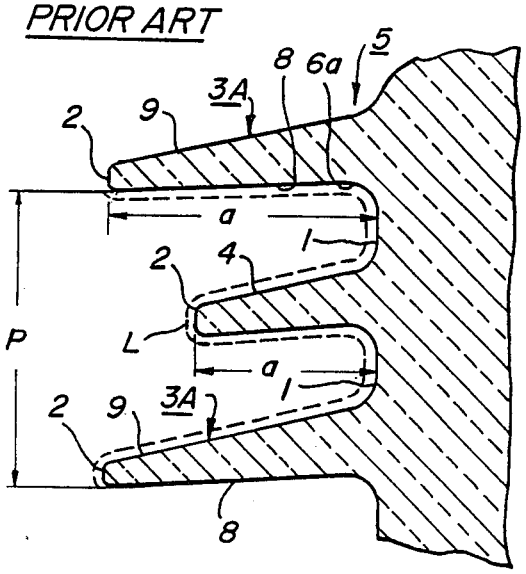
FIG. 6 PRIOR ART
FIG. 6 is an explanatory diagram of a conventional pollution-proof insulator.

FIG. 5 shows a schematic partial sectional view of a fourth embodiment of the invention. The rib 10 of this embodiment extends outwardly from the lower surface 8 of the shed 3 in an oblique fashion without being bent or curved. The obliquely extending rib 10 of this embodiment is also effective in suppressing local arcs and preventing the local arcs from moving as in the case of the rib 10 of the first embodiment.

As described in detail in the foregoing, with a pollution-proof insulator according to the invention, the specific leakage distance can be increased without reducing the effectiveness of the leakage distance in improvement of the pollution withstand voltage. Accordingly, the invention improves the anti-pollution characteristics of insulators to a great extent.

The pollution-proof insulators of the invention can be made shorter in height than conventional insulators of similar class with similar pollution resistivity. The short height inherently results in an improved mechanical strength of the insulator itself, such as strength against seismic vibration and other mechanical load. The short pollution proof insulators facilitate reduction in overall size of various installations of electric power network. Thus, the pollution-proof insulator of the invention provides sizeable economic savings in power industries.

Although the invention has been described with a certain degree of particularity by referring to preferred embodiments, numerous modifications are possible in parts and arrangement without departing from the scope of the invention as hereinafter claimed.

What is claimed is:

1. A pollution-proof insulator comprising a central core portion having a central axis, a shed extending substantially radially from said central core portion, and an annular rib extending downwardly from a lower surface of said shed, said rib being bent at an intermediate portion thereof such that a first portion of a lower edge of said rib extends downwardly at a first angle with respect to the central axis of said central core portion and a second portion of the lower edge of said rib extends outwardly with respect to said central core portion at a second angle with respect to the central axis of said central core portion, said second angle being from 60° to 85°.

2. A pollution-proof insulator as set forth in claim 1, wherein said insulator further comprises an additional rib which extends downwardly from the lower surface of the shed at a position between said central core portion and said rib with the second portion of the lower edge thereof directed outwardly, said additional rib providing an elongated leakage distance for the shed.

3. A pollution-proof insulator comprising a central core portion having a central axis, a plurality of sheds extending substantially radially from said central core portion and spaced apart in the longitudinal direction of said central core portion, and a plurality of ribs, one of said ribs extending downwardly from a lower surface of each of said sheds, each of said ribs being bent at an intermediate portion thereof such that a first portion of a lower edge of each rib extends downwardly at a first angle with respect to the central axis of said central core portion and a second portion of the lower edge of each rib extends outwardly with respect to said central core portion at a second angle with respect to the central axis of said central core portion, said second angle being from 60° to 85°.

4. A pollution-proof insulator of claim 3, wherein each of said ribs extends downwardly from the respective one of said sheds such that the first angle with respect to the central axis of said central core portion is from 5° to 40°.

5. A pollution-proof insulator of claim 3, wherein three spaces are defined between first and second longitudinally adjacent sheds, said three spaces comprising a shed-root space formed between the first portion of the lower edge of the rib extending from the first shed and the central core portion; an under-rib space formed between the second portion of the lower edge of the rib extending from the first shed and the upper surface of the second shed; and an outer-edge space formed between an upper surface of the rib and an outer portion of the lower surface of the first shed.

6. A pollution-proof insulator comprising a central core portion having a central axis, a plurality of sheds extending substantially radially from said central core portion and spaced apart in the longitudinal direction of the central core portion, and a plurality of first ribs, one of said first ribs extending downwardly from a lower surface of each of said sheds, each of said first ribs being bent at an intermediate portion thereof such that a first portion of a lower edge of each first rib extends downwardly at a first angle with respect to the central axis of said central core portion and a second portion of the lower edge of each first rib extends outwardly with respect to said central core portion at a second angle with respect to the central axis of said central core portion, said second angle being from 60° to 85°, wherein said insulator further comprises a plurality of second ribs, one of said second ribs extending downwardly from the lower surface of each of said sheds at a position between the first rib extending therefrom and said central core portion, said second rib providing an elongated leakage distance between adjacent sheds.

* * * * *